US007159255B2

(12) United States Patent
Piraino

(10) Patent No.: US 7,159,255 B2
(45) Date of Patent: Jan. 9, 2007

(54) SUPPORT BASE FOR A BED MATTRESS

(76) Inventor: Mario Piraino, 5 Nolan Close, East Doncaster, Victoria 3109 (AU)

( * ) Notice: Subject to any disclaimer, the term of this patent is extended or adjusted under 35 U.S.C. 154(b) by 0 days.

(21) Appl. No.: 10/344,336

(22) PCT Filed: Aug. 23, 2001

(86) PCT No.: PCT/AU01/01046

§ 371 (c)(1),
(2), (4) Date: Jul. 10, 2003

(87) PCT Pub. No.: WO02/15750

PCT Pub. Date: Feb. 28, 2002

(65) Prior Publication Data

US 2004/0098805 A1 May 27, 2004

(51) Int. Cl.
*A47C 23/06* (2006.01)

(52) U.S. Cl. ..... 5/238

(58) Field of Classification Search ..... 5/236.1, 5/237–239, 241, 244, 242, 243
See application file for complete search history.

(56) References Cited

U.S. PATENT DOCUMENTS 3,298,363 A * 1/1967 Parkin ..... 601/103
3,339,214 A * 9/1967 Janapol ..... 5/243
3,340,548 A * 9/1967 Janapol ..... 5/243
4,494,260 A 1/1985 Olds et al.
5,109,558 A * 5/1992 Di Blasi ..... 5/611
6,061,856 A 5/2000 Hoffmann

FOREIGN PATENT DOCUMENTS

| | | |
|---|---|---|
| DE | 4 442 719 | 12/1995 |
| EP | 0 103 807 | 3/1984 |
| EP | 103807 A2 * | 3/1984 |
| EP | 0 337 828 | 10/1989 |
| EP | 0 374 742 A1 | 6/1990 |
| FR | 2 662 063 | 11/1991 |
| GB | 2117234 | 1/1985 |

* cited by examiner

*Primary Examiner*—Michael Safavi
(74) *Attorney, Agent, or Firm*—Welsh & Katz, Ltd.

(57) ABSTRACT

A support base for a bed mattress (3) including a housing (1) having a plurality of transverse slats (2) for supporting said mattress wherein one or more of said slats are individually adjustable relative to said base to provide calibrated positive or negative height adjustment for each slat, characterized in that said height adjustment is provided by a means which is operable external to said housing.

8 Claims, 5 Drawing Sheets

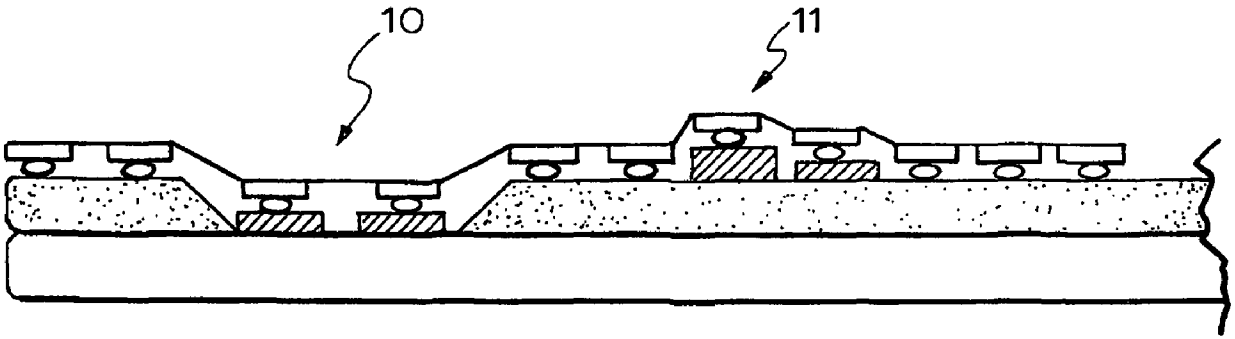
FIG. 2A.
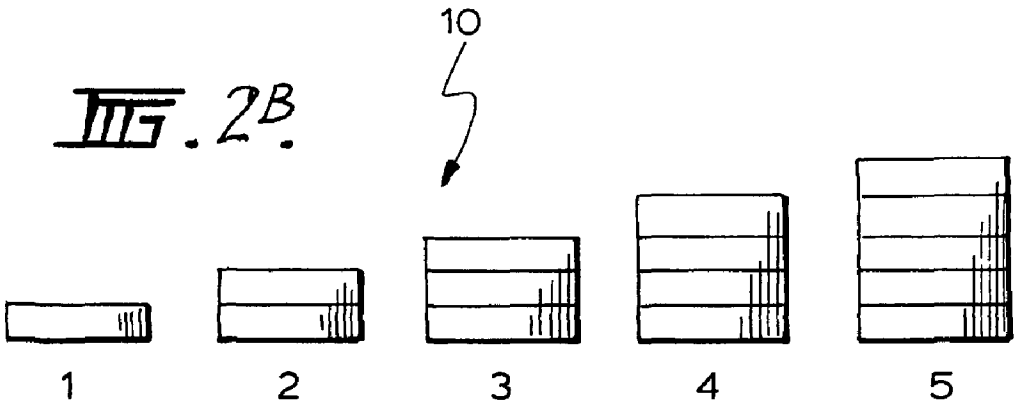
FIG. 2B.
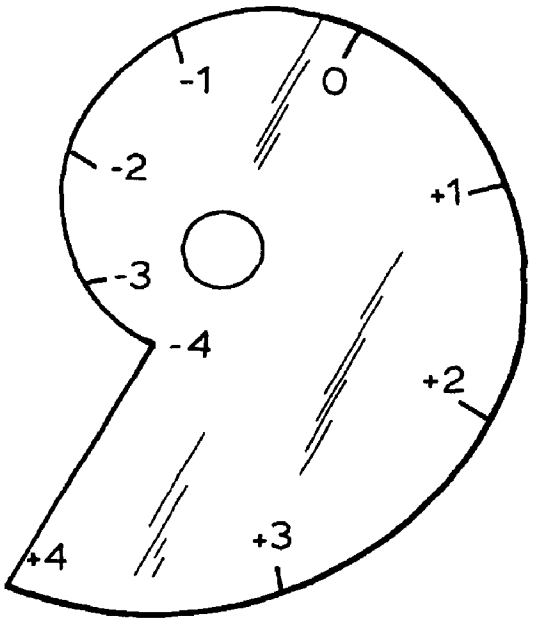

SUPPORT BASE FOR A BED MATTRESS

INTRODUCTION TO THE INVENTION

This invention relates to bedding apparatus and in particular to an improved bed base for supporting an inner sprung or other mattress.

BACKGROUND TO THE INVENTION

The combination of an upper mattress supported on a lower base forms a typical bedding apparatus in common use. The upper mattress can be of any type, composition or configuration to provide the necessary comfort and secondary support for the user. The lower base is used to elevate the mattress off the ground and to provide ventilation, but importantly to also provide controlled macro support for the upper mattress.

Macro support is important to give the mattress the correct and optimal overall support to suit the user's physique and orthopaedic requirements. The fine tuning or micro support of a bed is generally confined to the upper mattress which can be supplied in a range of hardnesses to suit the user. In addition, the upper mattress can be tailored to suit individual requirements with the provision of hybrid components to suit dual occupancy.

The correct and careful selection and adjustment of both the macro and micro support of a mattress is vital to achieve the optimal bedding support to suit the variety of user requirements which vary with the different physical and medical requirements of each individual.

To date, the ability of a bed base to provide adequate macro support has been limited by the crude systems available. Currently available base systems include innerspring bases and platform bases using transverse slats. While innerspring bases give the user an impression of "comfort" by feeling soft, this system provides minimal controlled macro support and results in a "bouncy feel" rather than adequate overall support for an upper mattress.

Platform bases also provide macro support but have limited adjustment potential even with the incorporation of double slats and firmness adjusters which allow individual slats to be adjusted to provide various degrees of flex over the length of the slat. Such systems do little to provide the upper mattress with the necessary macro support to give the user's body optimal orthopaedic support. Double slats may provide variable flex giving rise to differential support but such slats only allow a deflection difference of up to about 15 mm over a standard slat when under load. Adult human bodies may have shape differences between the shoulders and waist of up to perhaps 80 mm. Accordingly, the potential deflection compensation available from double slats is quite insufficient to cater for such variations in the end user. Furthermore, double slats do not provide an individual height adjustment for the slats but only an individual flex adjustment.

In order to provide a further level of macro adjustment, height adjustment of individual slats in a platform base would provide clear advantages. Whilst some prior art devices are known which provide slating adjustment for bed bases incorporating individual transverse slats, none of the known prior art devices provide a ready means of adjusting individual slats in a quantitative and calibrated manner so as to allow the user or a medical adviser a satisfactory means of making suitable adjustment to confidently meet an individual's particular requirements.

If such individual height adjustment could be provided and could be operated external to the bed base, a means of ready and convenient alteration of a bed's macro support would be achieved.

STATEMENT OF INVENTION

In one aspect, the invention provides a support base for a bed mattress including a housing having a plurality of transverse slats for supporting said mattress wherein one or more of said slats are individually adjustable relative to said housing to provide calibrated positive or negative height adjustment for each slat, characterised in that said height adjustment is provided by a means which is operable external to said housing. The height adjustment means may be (a) cams positioned at either end of a given slat, (b) elongate cams supporting the length of each slat, (c) general height adjusting blocks, or (d) height adjusting blocks calibrated to a height adjustment scale shared by other means for height adjustment, such as cams. If the elongate cams are made of suitable diameter the slats can be eliminated with the bed mattress supported directly on the cams, which function as slats.

Accordingly, in another aspect the invention provides a support base for a bed mattress including a housing having a plurality of transverse elongate cams for supporting said mattress and an adjustment means for said cams wherein one or more of said cams are individually adjustable relative to said housing to provide height calibrated adjustment for said bed mattress. Preferably said height adjustment means is provided by a means which is operable external to said housing.

The cams may be fixed to a common axle which protrudes outside the housing to provide the external access to said height adjustment means. The cams may also be provided with calibrations to provide quantitative data on the amount of adjustment occurring. Handles or other fittings may be used to operate the height adjustment means.

The adjustment can be either totally individual from one height adjustment means to the next, or may be coordinated between height adjustment means to provide rapid adjustment.

The height adjustment may also be achieved by "general" height adjusting blocks or may be faithfully duplicated by the use of height adjusting blocks corresponding to the cam calibrations.

The support base may be adapted for a range of bed sizes including single, double and larger sizes. The adjustment means can be coordinated for both sides of a multiple user bed or separate systems incorporated in either side.

In another aspect the invention provides a support base for a bed mattress wherein said support base housing has a hinged portion adapted for raising to support the user in a partially upright position wherein the raiseable portion of said housing incorporates one or more transverse slats or transverse elongate cams for supporting said mattress wherein the slats or cams are individually adjustable relative to said housing to provide local adjustment of said mattress wherein said adjustment is provided by a means which is operable external to said housing.

The invention will now be described with reference to the following figures.

FIG. 2*a* shows the positive and negative slat adjustment using height adjustment blocks.

FIG. 2*b* shows a calibrated cam and corresponding height blocks.

Figure 3:
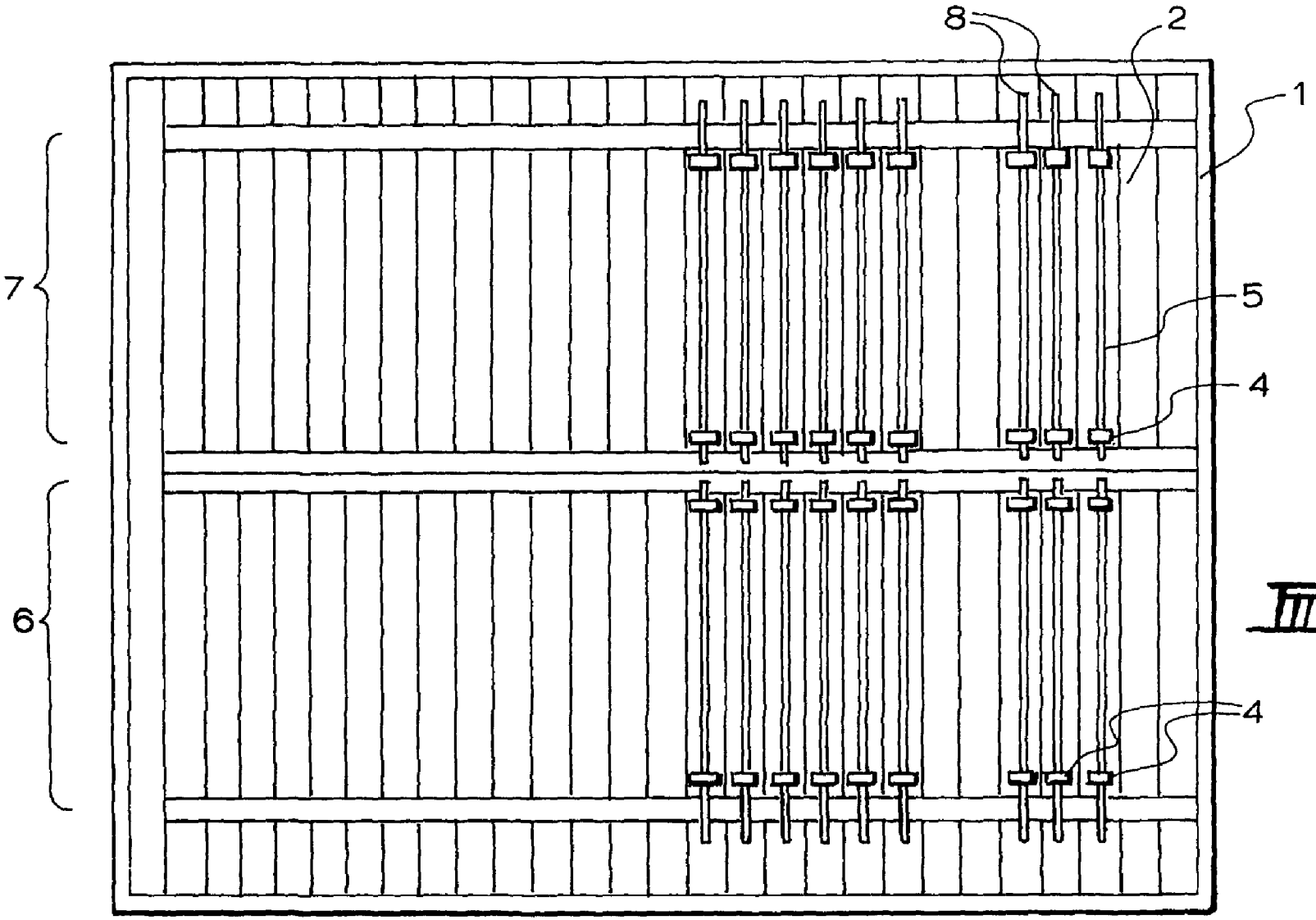

FIG. 3 shows a bottom plan view of the support base featuring cam adjustment.

Figure 4:
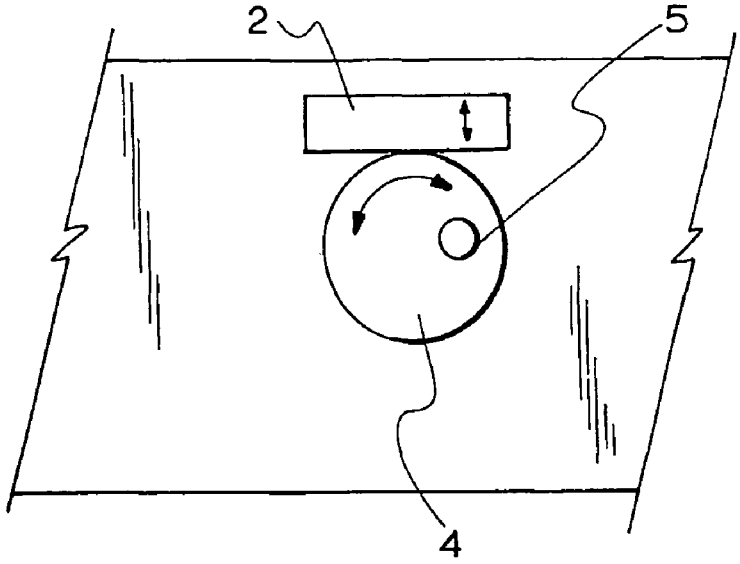

FIG. 4 shows the end view of an eccentrically mounted elongate cam.

Figure 5:
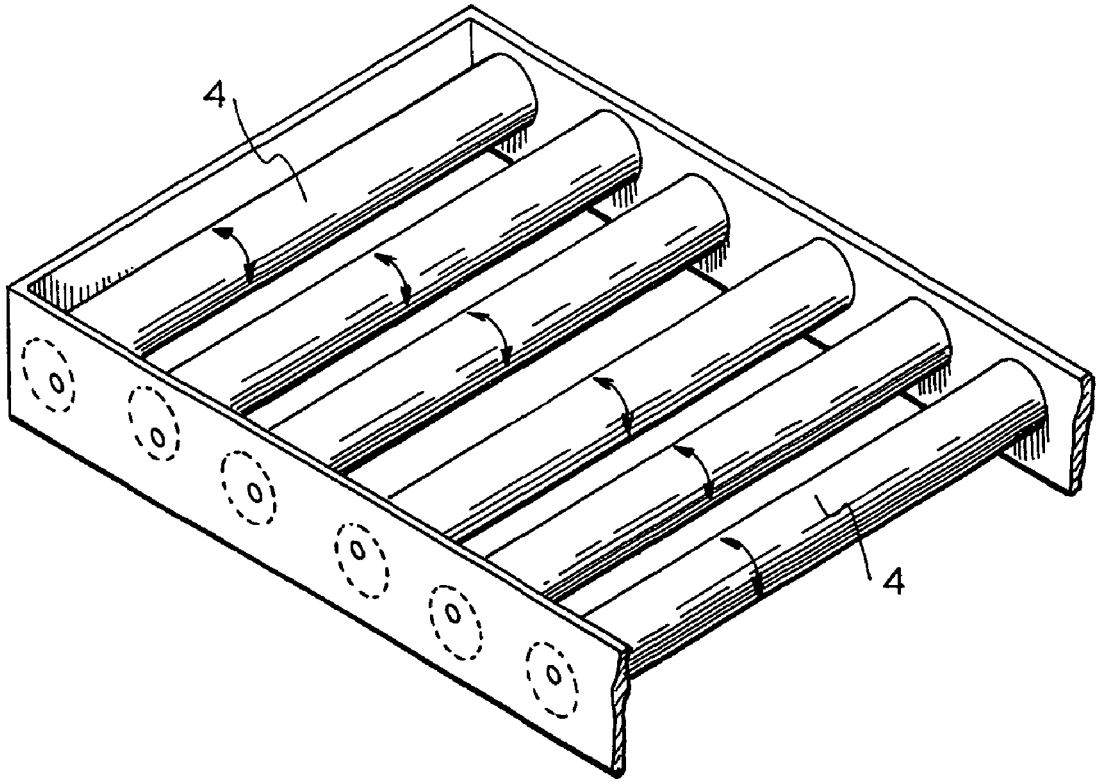

FIG. 5 shows a perspective view of a support base incorporating a plurality of elongate cams.

Figure 6:
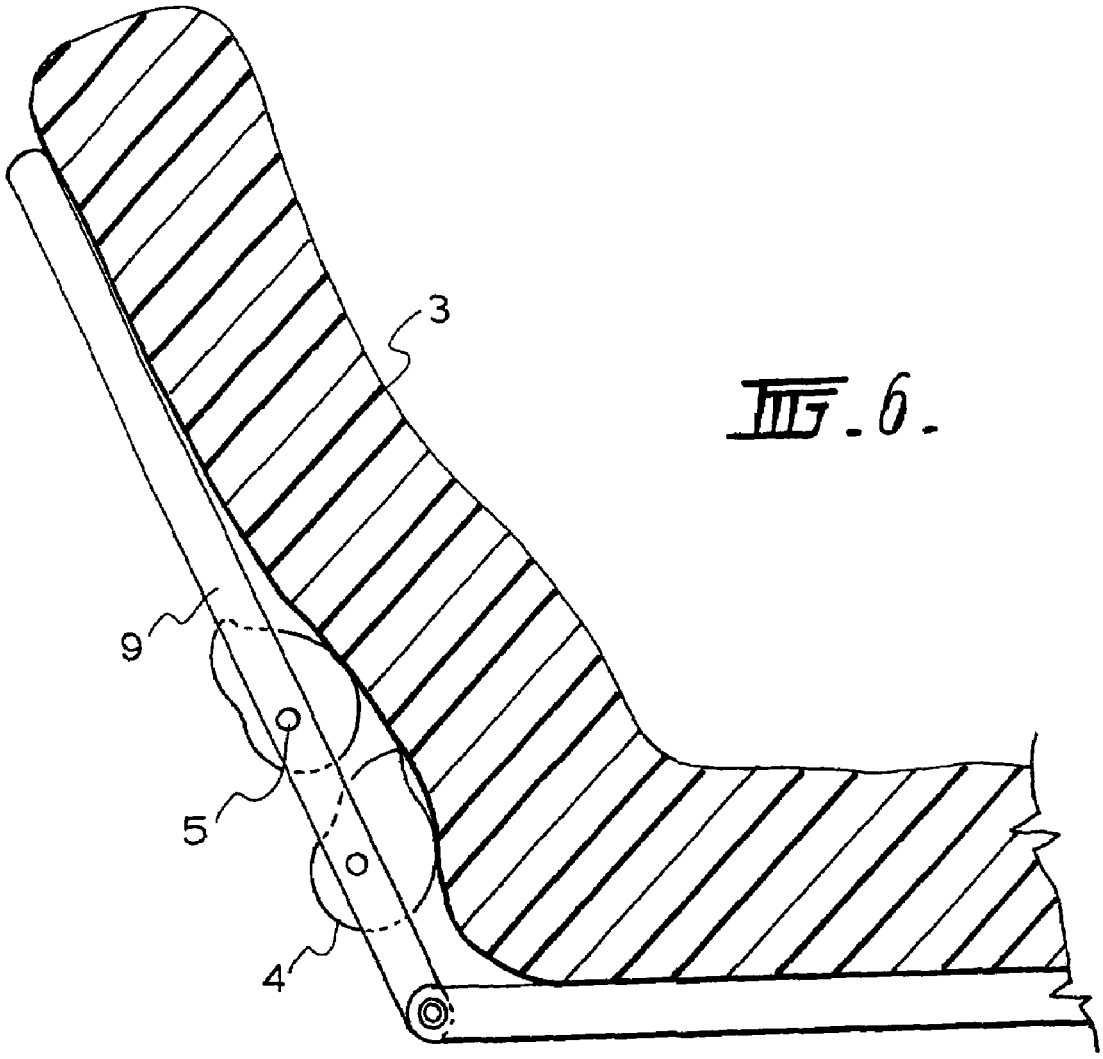

FIG. 6 shows a hospital or invalid bed incorporating the variable support features in the lumbar region.

DETAILED DESCRIPTION OF THE INVENTION

Figure 1:
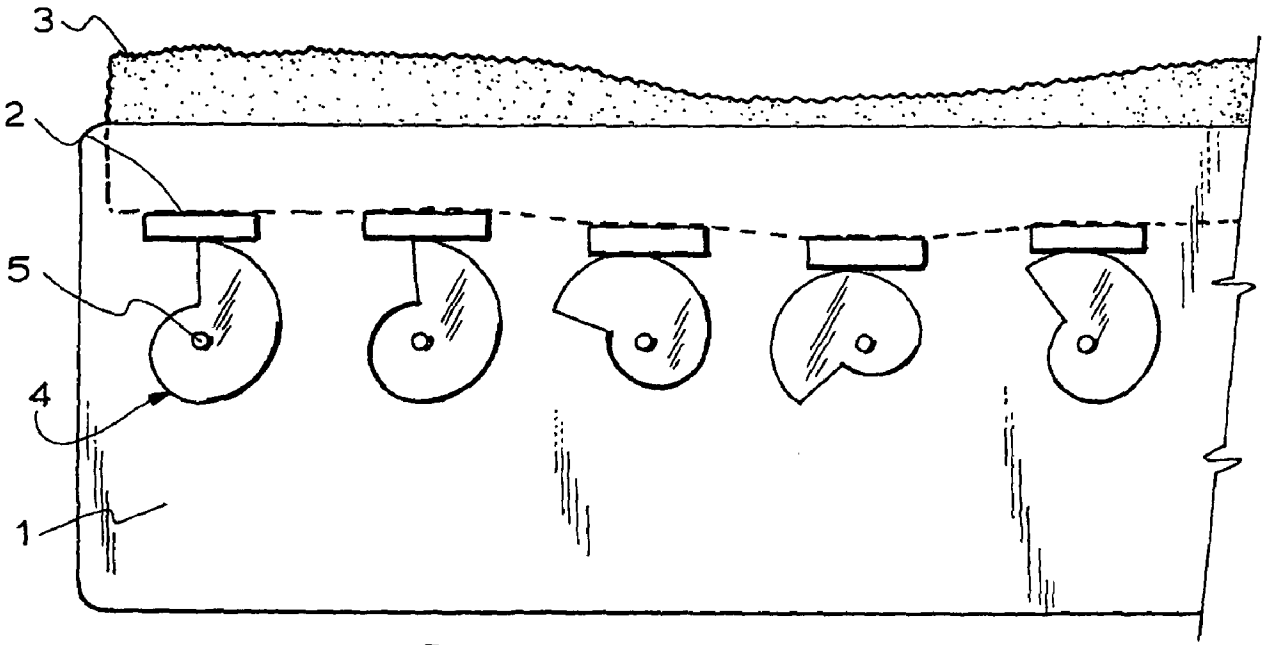
FIG. 1 shows a partial side view of the support base.

Referring firstly to FIG. 1 where a partial side view is shown of the mattress support of the invention. The mattress support is in the form of a support base adapted for supporting a bed mattress over the substantial underneath region of the mattress. The housing will generally take the form of a rectangular or square unit substantially shaped to correspond to the relevant sized mattress including single, double, queen, king etc. The mattress is supported on the top region of the housing by way of a plurality of transverse supporting slats 2 which are positioned within the housing 1 so as to provide the support for the mattress 3. The slats 2 are individually adjustable so as to provide varying heights relative to the housing 1. Each slat is provided with an adjustable cam 4 at either end rotating about an axle 5. The cam 4 cooperates with the supporting slats 2 such that by rotation around the axle 5 allows for the movement of the slat up or down so as to provide the required height for the individual slat.

Figure 2:
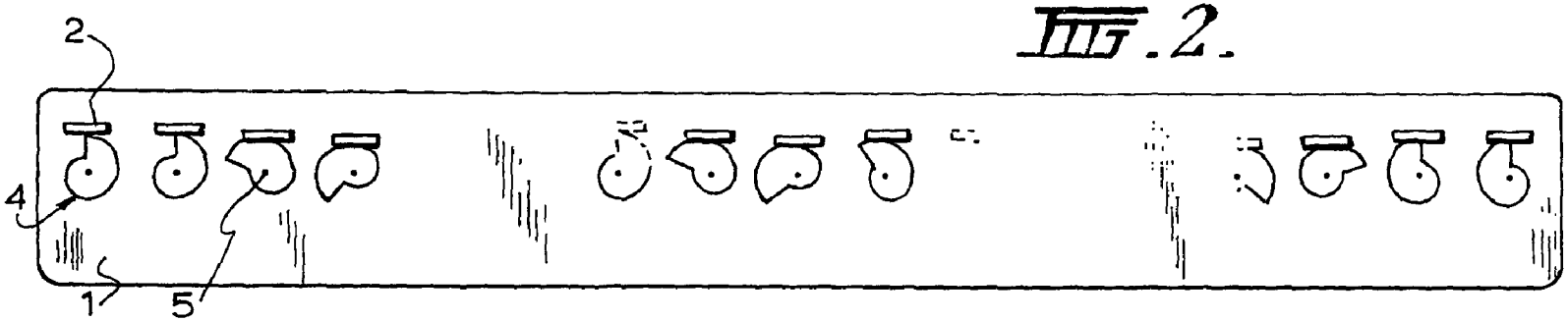
FIG. 2 shows a full side view of the support base without mattress fitted.

FIG. 2 shows a side view of the support base of the invention where the housing 1 accommodates a plurality of slats 2 along the length of the housing for full and total support of the mattress (not shown). The cams 4 are operable by rotating the axle 5 which can be accessed from the exterior of the housing by way of either protruding handles which can be rotated or alternatively the axles can be accessed with an appropriate tool.

FIG. 2*a* shows the support base where the slats have been lowered in region 10 by activation of said cams, to accommodate the hip or shoulder region of the user. If using calibrated height adjustment blocks, this setting would correspond to a cam reading of −2 (−3 from the support and +1 from the block). In region 11 the cams have been raised to accommodate the waist or neck region of the user corresponding to a cam reading of +2 and +1 for the slats shown.

The calibrated cam is shown in FIG. 2*b* where rotation of the cam by a given amount will provide a measure of height adjustment. The cam has calibrations corresponding to linear amounts of lift or drop; for example 5 mm per increment. This calibrated adjustment allows the user to make adjustments in an informed and methodical manner. Moreover, the adjustment up or down by way of the cams can be faithfully replicated in other beds by using blocks 10 which correspond to the movements of the cam in other bases. In this manner, the base of the invention, incorporating the cams, can be used by a medical practitioner to measure the patient and determine the adjustments needed and the patient can be supplied with the corresponding array of lifting blocks for installation in their home bed. In this way the more complex cam unit can be used by a selection of practitioners to benefit patients in need of dedicated bed support.

That is, while a practitioner may have need of an easily adjustable bed such as is provided by the use of cams, a patient, once diagnosed, may not require a variable height bed implemented by cams, but may simply require a variable height bed implemented by blocks, the blocks being set to heights determined by the practitioner using a cam adjustable bed.

Referring now to FIG. 3 a plan view of the invention is shown where the support base has a rectangular housing 1 and a plurality of slats 2 running transversely across the base over the whole length of the housing. The particular embodiment shown in FIG. 3 has slats provided for each side of the base which are individually adjustable from side to side and along the length thereof. Such individual adjustment allows complete tuning of the macro support for each side of a mattress placed on top thereof.

Each slat has a cam 4 positioned at either end connected and operated via an axle 5. The slats may be divided into two separate sides 6 and 7 to provide for independent adjustment for each user. The slats have a cam 4 at either end to provide the variable height support which can be adjusted by rotating the axle 5 which protrudes to the exterior of the housing 1. The external protrusions 8 allow ready adjustment of the height of the individual slats.

Referring now to FIGS. 4 and 5 an alternative embodiment of the invention is shown where the supporting slats 2 are individually adjustable and supported by an elongate cam 4 which can be eccentrically pivoted about the axle 5. Such elongate cams provide a simplified operating mechanism and ensure uniform adjustment of each slat along its length.

An extension of the previously detailed aspect of the invention may be provided as shown in FIG. 5 where the elongate adjustable cams 4 provide support for the mattress directly without the need for riding slats. Such an embodiment will depend on suitably dimensioned cams 4 or alternatively a sufficient number of cams closely placed together so as to provide adequate point support for said mattress.

FIG. 6 details another embodiment of the invention where the support base is in the form of a folding unit having a section pivotal for raising so as to support the user in a partially elevated position. Such a support base would be particularly suitable for hospital or invalid applications where the user requires elevation in a variety of positions. Such currently available units however suffer from the inability to provide adequate lumbar support and the invention provides features allowing such deficiencies to be directly and efficiently addressed. The raiseable portion of the mattress support 9 may be provided with one or more cams 4 which can be either elongate and/or cooperate with a slat. In the example where the cams are elongate, and function without a slat, they may be used in place of slats over that given region and operate to push the mattress 3 in or out in accordance with the user's requirements. The elongate cams 4 may be shaped to function as a cam or alternatively, may be in the form of cylinders with eccentrically mounted axles 5. In this manner, the features of the invention can be applied over a limited area of a support base to provide specific adjustment features to a particular region which can be adjusted readily and in accordance with the user's requirements.

The support base of the invention provides for the first time, a fully adjustable and variable macro support for a bed mattress. In particular, embodiments of the invention utilising cams may provide the ability to adjust and tailor the heights of individual slats of the support base whilst the mattress is in situ and indeed the slats can be adjusted whilst the occupant is lying on the fully configured bed.

The slats can be either totally independent in their adjustment or if desirable some slats could be interconnected to speed up and/or coordinate the adjustment regime of a given bed.

In use the support base of the invention would be used in conjunction with a suitable mattress and the profile of the user would allow either a professional orthopaedic adviser or an informed user to adjust the macro support for the mattress so as to provide the necessary differentiation required over the length of the mattress in order to properly and correctly provide the necessary orthopaedic support for each individual user. The ease and confidence with which the support base of the invention can be adjusted allows the user to make various adjustments if and when required, and the infinite adjustment available by way of the operating cams and fine adjustment available by way of height adjustment blocks allow complete variation as would be required by any user. The adjusting handles could be provided with optional reference readings and calibration to allow quantitative adjustment of the macro support for a mattress so as to assist the user or practitioner to obtain the ideal support required. Such quantitative adjustment facilities of the support base of the current invention would also allow professional advisers to conduct assessments of individual patients and provide recommendations for the patient to make adjustments to the support base in accordance with their medical requirements without the need for attending the user's bedside.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A support base for a bed mattress including a housing having a plurality of transverse slats for supporting said mattress wherein one or more of said slats are individually adjustable relative to said housing to provide calibrated positive or negative height adjustment for each slat, wherein said height adjustment is provided by cams fitted to said housing for rotational movement and co-operation with said slats to impart a vertical height adjustment to said slats, said cams operated in pairs with one cam positioned at or near each end of said slats, wherein said cam pairs are operated simultaneously.

2. The support base according to claim 1 wherein said calibration indicates the height of said slats relative to said housing.

3. The support base according to claim 1 wherein said cam pairs are fitted to a common axle which can be accessed from outside said housing.

4. The support base according to claim 1 wherein said cams extend the length of each individual slat.

5. A support base according to claim 1 wherein said cams are operable external to said housing.

6. The support base according to claim 1 wherein said slats are calibrated in height by said cams.

7. The support base according to claim 1, wherein said adjustable slats enable height adjustment for more than one user position of said bed mattress.

8. The support base according to claim 1 wherein said housing has a hinged portion for raising to support the user in a partially upright position wherein the raiseable portion of said housing incorporates one or more transverse slats or transverse elongate cams for supporting said mattress wherein said slats or cams are individually adjustable relative to said housing to provide local adjustment of said mattress wherein said adjustment is provided by means which are operable external to said housing.

* * * * *